US007571555B1

(12) United States Patent
Powell, Sr.

(10) Patent No.: US 7,571,555 B1
(45) Date of Patent: Aug. 11, 2009

(54) PNEUMATICALLY CUSHIONED SHOE SOLE

(76) Inventor: M. Shayne Powell, Sr., 240 Drummond Rd., Traveler's Rest, SC (US) 29690

( * ) Notice: Subject to any disclaimer, the term of this patent is extended or adjusted under 35 U.S.C. 154(b) by 679 days.

(21) Appl. No.: 11/389,963

(22) Filed: Mar. 28, 2006

(51) Int. Cl.
*A43B 7/06* (2006.01)

(52) U.S. Cl. ..... 36/3 B; 36/29

(58) Field of Classification Search ..... 36/3 R, 36/3 B, 28, 29
See application file for complete search history.

(56) References Cited

U.S. PATENT DOCUMENTS

| | | | | |
|---|---|---|---|---|
| 1,596,923 | A | 8/1926 | Cooney | |
| 2,751,692 | A * | 6/1956 | Cortina | 36/3 B |
| 4,078,321 | A * | 3/1978 | Famolare, Jr. | 36/3 B |
| 4,438,573 | A * | 3/1984 | McBarron | 36/3 B |
| 4,462,171 | A * | 7/1984 | Whispell | 36/3 B |
| 4,798,009 | A * | 1/1989 | Colonel et al. | 36/28 |
| 4,888,887 | A * | 12/1989 | Solow | 36/3 R |
| 4,910,887 | A * | 3/1990 | Turner et al. | 36/114 |
| 4,939,851 | A * | 7/1990 | Miller | 36/3 B |
| 4,991,317 | A | 2/1991 | Lakic | |
| 5,199,191 | A | 4/1993 | Moundjian | |
| 5,400,526 | A * | 3/1995 | Sessa | 36/3 B |
| 5,598,645 | A | 2/1997 | Kaiser | |
| D387,410 | S | 12/1997 | Peterson | |
| 5,996,253 | A | 12/1999 | Spector | |
| 6,305,100 | B1 * | 10/2001 | Komarnycky et al. | 36/3 R |
| 6,405,456 | B1 | 6/2002 | Nichelson | |
| 6,948,260 | B2 * | 9/2005 | Lin et al. | 36/3 B |
| 2001/0007176 | A1 * | 7/2001 | Attilieni | 36/3 B |
| 2002/0194747 | A1 | 12/2002 | Passke et al. | |
| 2005/0138838 | A1 * | 6/2005 | Lin et al. | 36/3 B |
| 2005/0223594 | A1 * | 10/2005 | Issler | 36/3 B |
| 2007/0000148 | A1 * | 1/2007 | Lin et al. | 36/3 B |
| 2007/0011907 | A1 * | 1/2007 | Polegato Moretti | 36/3 B |
| 2007/0028483 | A1 * | 2/2007 | Miyata | 36/3 B |

* cited by examiner

*Primary Examiner*—Marie Patterson
(74) *Attorney, Agent, or Firm*—Crossley Patent Law; Mark A. Crossley

(57) ABSTRACT

A pneumatically cushioned shoe sole for use with virtually any type of shoe, comprising a u-shaped outsold with inlet tubes connected via a transfer tube, an insole of memory foam supported by air chambers and mini chambers, the chambers and an air inlet connected by a transfer channel is disclosed. The air inlet further comprises a check valve and both a removable inlet insert and a removably adjustably opened valve.

14 Claims, 3 Drawing Sheets

PNEUMATICALLY CUSHIONED SHOE SOLE

BACKGROUND OF THE INVENTION

Countless designs have been offered for cushioning people's shoes against the contact surfaces to which shoes are used. Cushioning is desirable not only in a static position but even more when walking or running. Effective cushioning faces many challenges. Cushioning must offer a softness not found without it, and at the same time must maintain support. Various pneumatic approaches have been utilized in shoe cushioning. The present invention offers unique solutions for effectively cushioning of all types of shoes.

FIELD OF THE INVENTION

The present invention relates to shoe soles and more specifically to a pneumatically cushioned shoe sole.

SUMMARY OF THE INVENTION

The general purpose of the pneumatically cushioned shoe sole, described subsequently in greater detail, is to provide a pneumatically cushioned shoe sole which has many novel features that result in an improved pneumatically cushioned shoe sole which is not anticipated, rendered obvious, suggested, or even implied by prior art, either alone or in combination thereof.

To accomplish this, the invention is comprised of an outsole which surrounds the insole on three sides. The bottom of the u-shaped outsole contacts a surface upon which the shoe traverses. The outsole is comprised of a plurality of substantially equidistantly spaced horizontal inlet tubes. The inlet tubes communicate via a transfer tube which runs throughout the inner perimeter of the outsole. The inlet tubes provide a unique cushioning effect to what would otherwise be a typical flexible rubber like outsole. The insole is bounded on three sides by the outsole. The insole is unique in that it is comprised of memory foam. Memory foam is well known in the art of sleeping bed manufacturing and the like. Memory foam temporarily conforms to a foot. The memory foam is supported by the air chambers and mini chambers of the invention. These chambers provide support that the memory foam would not otherwise have. The chambers communicate via a transfer channel. The heel area chamber communicates with ambient air via the air inlet. A check valve is disposed within the air inlet such that air intake is encouraged but air exhaust is hampered. This retains the supporting traits of the insole while allowing slow air escape when the shoe is not in use.

Two different fittings are offered for adapting the air intake to ambient air. One is a removable inlet insert. The other is an adjustably opened valve for further controlling air intake.

Thus has been broadly outlined the more important features of the pneumatically cushioned shoe sole so that the detailed description thereof that follows may be better understood and in order that the present contribution to the art may be better appreciated.

Numerous objects, features and advantages of the pneumatically cushioned shoe sole will be readily apparent to those of ordinary skill in the art upon reading the following detailed description of presently preferred, but nonetheless illustrative, examples of the pneumatically cushioned shoe sole when taken in conjunction with the accompanying drawings. In this respect, before explaining the current examples of the pneumatically cushioned shoe sole in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the pneumatically cushioned shoe sole.

It is therefore important that the claims be regarded as including such equivalent constructions insofar as they do not depart from the spirit and scope of the present invention.

Objects of the pneumatically cushioned shoe sole, along with various novel features that characterize the invention are particularly pointed out in the claims forming a part of this disclosure. For better understanding of the pneumatically cushioned shoe sole, its operating advantages and specific objects attained by its uses, refer to the accompanying drawings and description.

DETAILED DESCRIPTION OF THE DRAWINGS

With reference now to the drawings, and in particular FIGS. 1 through 4 thereof, example of the pneumatically cushioned shoe sole employing the principles and concepts of the present invention and generally designated by the reference number 10 will be described.

Figure 1:
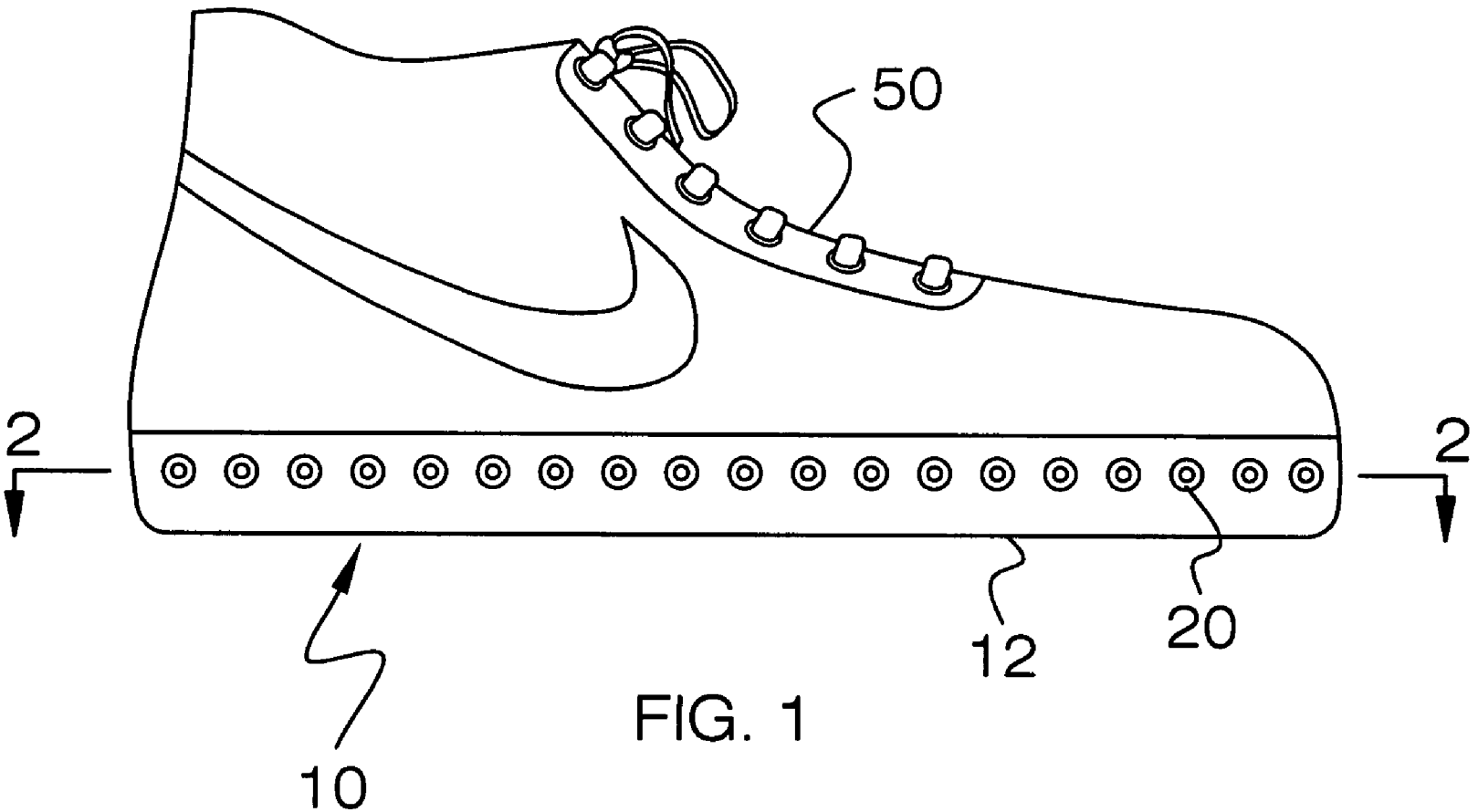
FIG. 1 is a lateral elevation of the invention affixed to an athletic shoe.

Referring to FIG. 1, the invention 10 substantially resembles any flexible sole of a typical shoe 50. The invention 10 visually differs, partially, due to the inlet tubes 20 disposed equidistantly throughout the outsole 12 of the invention 10.

Figure 2:
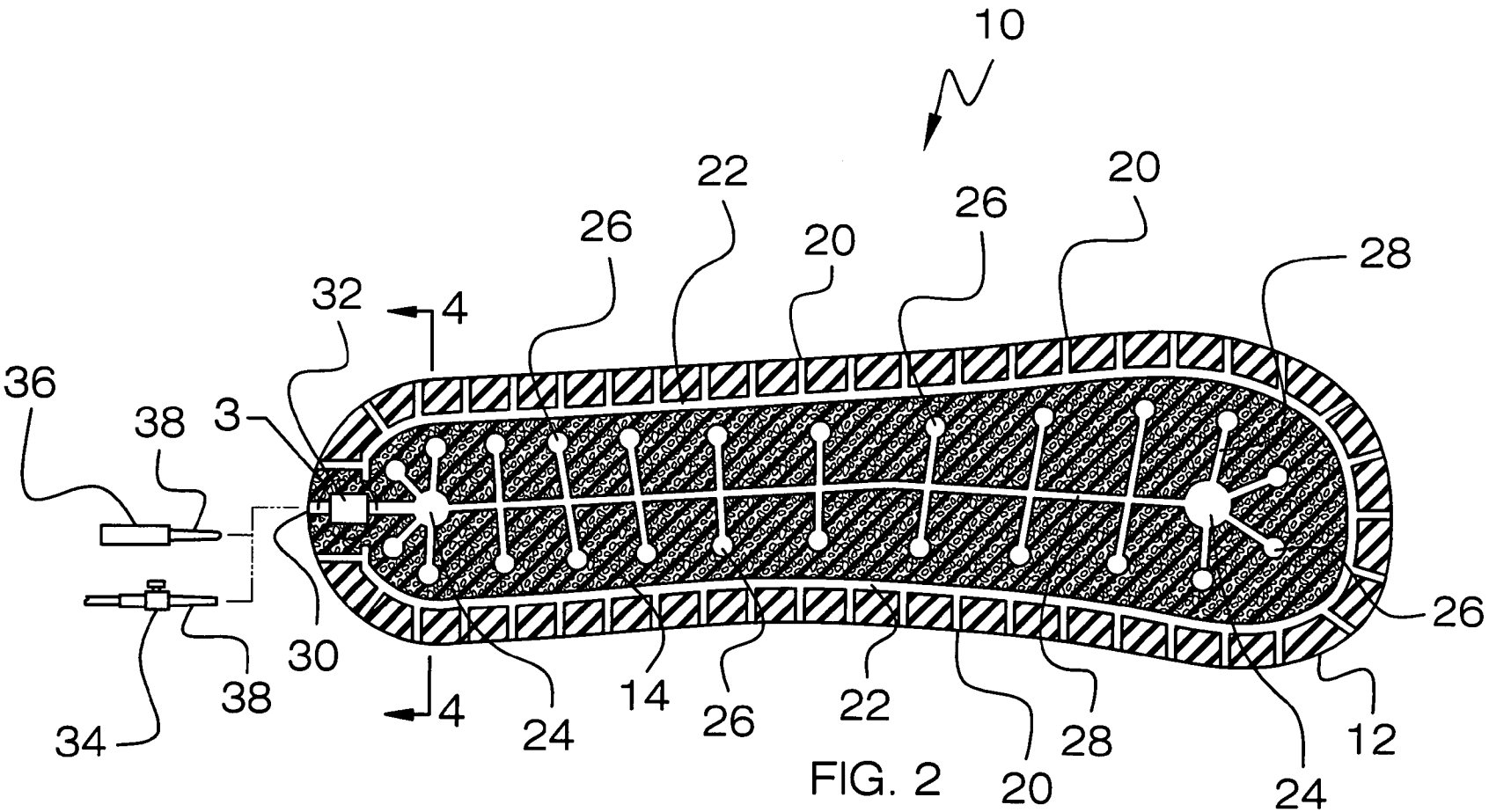
FIG. 2 is a bottom plan of the invention.

Referring to FIG. 2, the invention 10 comprises a pneumatically cushioned shoe sole for fitting a shoe 50. The invention 10 can be utilized to fit virtually any shoe 50. The invention 10 comprises a flexible u-shaped outsole 12. The bottom of the u-shape faces a surface to be contacted by the outsole 12. A plurality of air inlet tubes 20 are arranged horizontally and equidistantly within the sides of the outsole 12. A transfer tube 22 connects the air inlet tubes 20. A flexible insole 14 is disposed within the bounds of the outsole 12. The air inlet 30 is disposed at the rear of the insole 14. The air inlet 30 connects to the heel chamber 24 in the heel area of the insole 14. The front chamber 24 is disposed in a front area of the insole 14. A plurality of mini chambers 26 are arranged throughout the insole 14. The transfer channel 28 connects the heel chamber 24, the front chamber 24, and the mini chambers 26. The air inlet 30 connects the heel chamber 24 to ambient air. The adjustably opened valve 34 is removably inserted into the air inlet 30 via the female end 38 of the adjustably opened valve 34.

Alternately, the inlet insert 36 may be used in place of the adjustably opened valve 34. The female end 38 of the inlet insert 36 is removably inserted into the air inlet 30. The insole

14 is composed of memory foam. Memory foam provides a unique cushioning effect by which the foam gives and retains the temporarily molded shape to a foot until the foot is removed. Memory foam is known in the art of sleeping beds and the like. The memory foam is usable within the insole 14 only because of the unique air chambers 24 and mini chambers 26 of the invention 10 which offer pneumatic support. The check valve 32 prevents deflation of the chambers 24 and mini chambers 26, thereby providing the support needed. In this way, the invention 10 uniquely molds to a foot.

Figure 3:
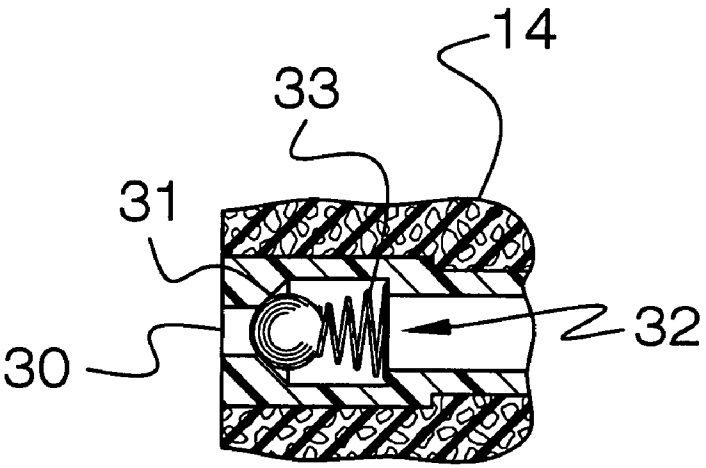
FIG. 3 is a top cross sectional view of the check valve of the invention of FIG. 2, taken along the line 3-3.

Referring to FIG. 3, the check valve 32 is comprised of a ball 31 held in closed position via the spring 33. Air is drawn into the air inlet 30 but does not pass back out easily.

Figure 4:
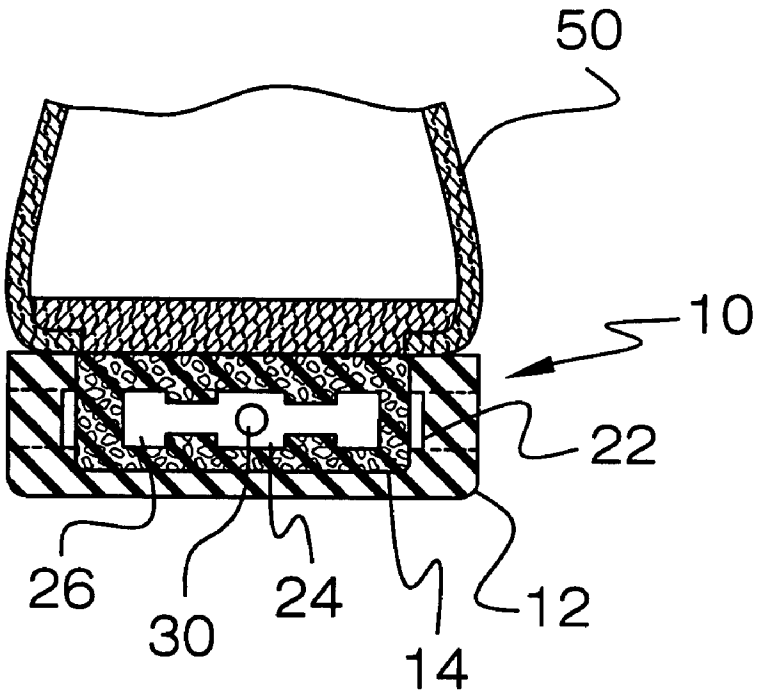
FIG. 4 is a rear cross sectional view of the heel area of the invention of FIG. 2, taken along the line 4-4.

Referring to FIG. 4, the flexible but more rigid outsole 12 bounds the insole 14 on three sides, with the upper side of the insole 14 against an inner sole of a shoe 50. The transfer tube 22 is within the inner portion of the outsole 12.

With respect to the above description then, it is to be realized that the optimum dimensional relationships for the parts of the pneumatically cushioned shoe sole, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pneumatically cushioned shoe sole for fitting a shoe, the sole comprising a flexible u-shaped outsole, the bottom of the u-shape facing a surface to be contacted;

a plurality of air inlet tubes arranged horizontally and equidistantly within the sides of the outsole;

a transfer tube connecting the air inlet tubes;

a flexible insole disposed within the bounds of the outsole;

a heel chamber in a heel area of the insole;

a front chamber in a front area of the insole;

a plurality of mini chambers arranged throughout the insole;

a transfer channel connecting the heel chamber, front chamber, and mini chambers;

an air inlet at a rear of the insole, the air inlet connecting the heel chamber to ambient air.

2. The invention in claim 1 wherein the insole is composed of memory foam.

3. The invention in claim 1 wherein the air inlet further comprises a check valve.

4. The invention in claim 2 wherein the air inlet further comprises a check valve.

5. A pneumatically cushioned shoe sole for fitting a shoe, the sole comprising a flexible u-shaped outsole, the bottom of the u-shape facing a surface to be contacted;

a plurality of air inlet tubes arranged horizontally and equidistantly within the sides of the outsole;

a transfer tube connecting the air inlet tubes;

a flexible insole disposed within the bounds of the outsole;

a heel chamber in a heel area of the insole;

a front chamber in a front area of the insole;

a plurality of mini chambers arranged throughout the insole;

a transfer channel connecting the heel chamber, front chamber, and mini chambers;

an air inlet at a rear of the insole; the air inlet connecting the heel chamber to ambient air;

an adjustably opened valve within the air inlet.

6. The invention in claim 5 wherein the insole is composed of memory foam.

7. The invention in claim 5 wherein the air inlet further comprises a one-way check valve, whereby air is allowed into the air inlet.

8. The invention in claim 6 wherein the air inlet further comprises a one-way check valve, whereby air is allowed into the air inlet.

9. The invention in claim 7 wherein the adjustable opened valve is exterior to the check valve.

10. The invention in claim 8 wherein the adjustable opened valve is exterior to the check valve.

11. The invention in claim 6 wherein the adjustably opened valve is removable.

12. The invention in claim 7 wherein the adjustably opened valve is removable.

13. The invention in claim 8 wherein the adjustably opened valve is removable.

14. The invention in claim 9 wherein the adjustably opened valve is removable.

* * * * *